United States Patent [19]

Hu

[11] Patent Number: 5,032,699

[45] Date of Patent: Jul. 16, 1991

[54] STRUCTURE INDUCTION HEATING WOK

[76] Inventor: Loong-Chiang Hu, No. 12, Lane 162, Kwang Ming Road Chien Chu Village, Wu Jih Shiang, Taichung County, Taiwan

[21] Appl. No.: 662,834

[22] Filed: Mar. 1, 1991

[51] Int. Cl.[5] ..... H05B 6/12

[52] U.S. Cl. ..... 219/10.493; 219/10.67; 219/10.75; 219/10.79; 99/451; 99/DIG. 14

[58] Field of Search ..... 219/10.493, 10.491, 219/10.75, 10.67, 10.79, 432; 99/DIG. 14, 451, 413; 426/244

[56] References Cited

U.S. PATENT DOCUMENTS 4,492,853 1/1985 Lam ..... 219/432
4,527,031 7/1985 Aparicio ..... 219/10.491
4,555,616 11/1985 O'Brien ..... 219/432
4,919,950 4/1990 Mak ..... 426/233

*Primary Examiner*—Philip H. Leung

[57] ABSTRACT

An improved structure induction heating wok comprising a wok, with a handle and pivoted on one side, from whose lower surface two contact rods extend, a magnetic core wound by a coil, driven by an A.C. power supply, and a bowl shaped yoke with a hollow well containing liquid mercury formed on the upper rim thereon. Wherein, when the pan is in a lowered position, the two contact rods are inserted into the mercury filled hollow well allowing an induced current in the yoke to flow through the contact rods and wok pan to generate heat therein. By pulling up on the handle, the wok pan tilts upwards about the pivot to allow the foodstuff within the wok to be rapidly removed.

2 Claims, 4 Drawing Sheets

STRUCTURE INDUCTION HEATING WOK

BACKGROUND OF THE INVENTION

The present invention relates to an induction heating wok, and more particularly to an improved structure induction heating wok that enables its wok pan to be tilted and the foodstuff therein to be easily removed.

A wok is a large, round concave metallic pan used for cooking that originated in asia but has now found widespread use throughout the world.

While most woks are heated by gas or ohmic electric heating, larger woks of close to a meter or more in diameter often use an electrical induction heater that is integrally attached to the bottom of the wok.

Though such an inductively heated wok has the advantages of rapid heating and cooking of the large quantities of food stuff it was designed to process, it has the disadvantage of being too massive to be manually manipulated. After the food stuff has been cooked, removal is usually facilitated by shoveling the food stuff out parcel by parcel.

The improved structure induction heating wok overcomes this problem by allowing the wok pan, while still maintaining electrical contact with the induction heating unit below when in a lowered position, to be independantly tilted upwards about a pivot. The foodstuff in the wok can then be much more rapidly shoveled to a secondary container.

SUMMARY OF THE PRESENT INVENTION

The improved structure induction heating wok of the present invention has as a main objective to provide an induction heating wok whose wok can be tilted upwards about a pivot independantly of the heavy induction heating unit to facilitate rapid removal of foodstuff within the wok.

A conventional induction heating cooking wok comprises a large copper wok, with a bracket shaped yoke welded to its underside, a soft magnetic core bound with copper coil and fixed within the armature, and an alternating current power source driving the copper coil. An alternating magnetic field from the core generated by the alternating current in the coil induces a current in the armature which must pass through the copper wok which is heated by the resistance losses.

The improvement comprises the addition of two contact rods to the wok, which protrude from its bottom, and the formation of a hollow contact well along the rim of a bowl shaped yoke which is now physically separate from the wok. Liquid mercury is present in the contact wells.

The ends of the contact rods and the interior cavity of the contact well are so shaped that when the contact rods are lowered into the contact well, the mercury in the well is displaced so that a thin film of mercury remains between the flat contact face at the bottom of the interior cavity of the contact well and the contact faces at the lower ends of the contact rods.

Whereby, the copper wok, which now has a handle on one side and is hinged on an opposing side, can be raised manually by lifting the handle and tilting the wok to one side. When in use the wok is lowered with the contact ends of the contact rods resting within the contact wells of the yoke.

The induced current in the yoke then passes through the mercury film and into the copper wok through the contact rods, to heat the wok and any food stuffs within it.

PREFERRED EMBODIMENT OF THE PRESENT INVENTION

Figure 1:
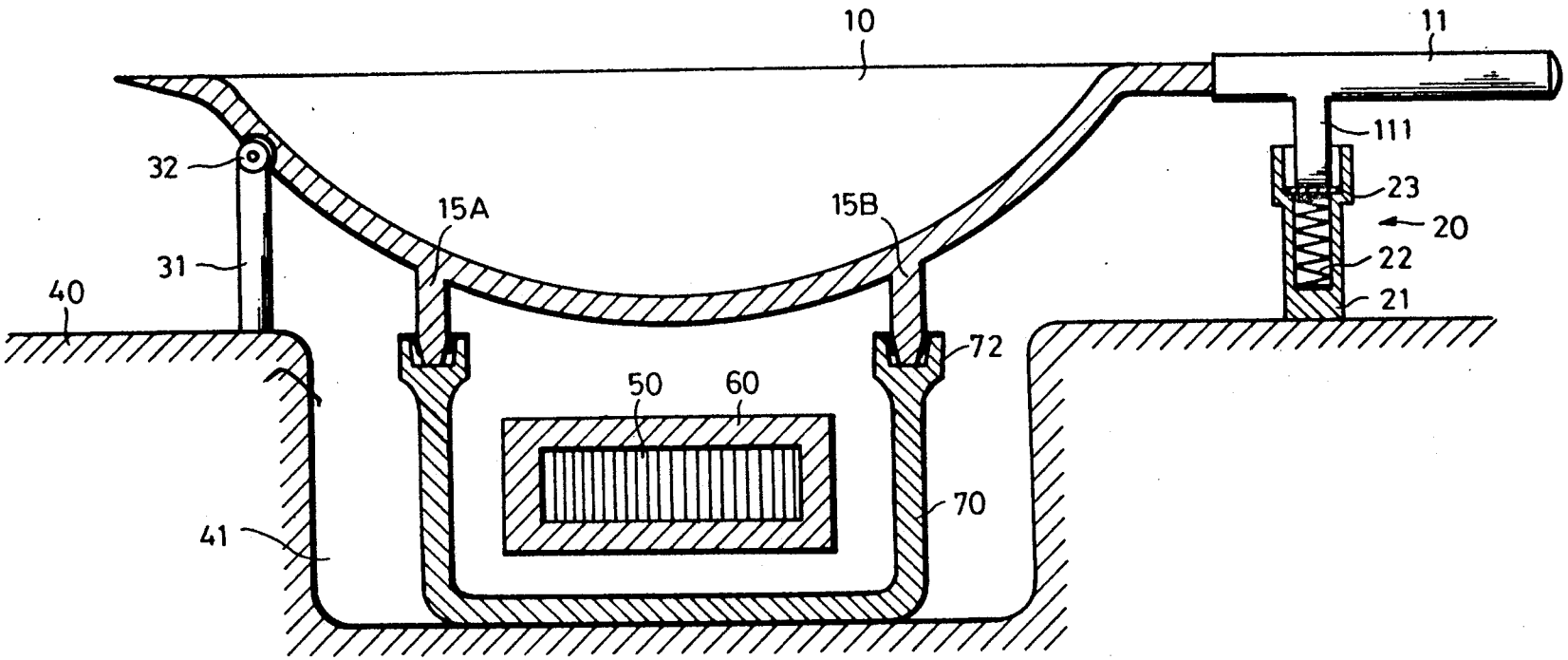
FIG. 1 is a schematic sectional view of the improved structure induction heating wok of the present invention, with the wok in a lowered position.

Referring to FIG. 1, the improved structure induction heating wok of the present invention comprises a round, concave copper wok pan 10 supported over a base 40, and an induction heating unit disposed under wok pan 10 in a depression 41 of base A handle 11 extends laterally from the rim of wok pan 10. A plunger 111, formed on handle 11, extends downwards into a rest 20. Support 20 consists of a seat 21, a spring 22 disposed within a lower cylindrical cavity in seat 21, and a disc shaped stopper 23 disposed in an upper cylindrical cavity of a larger diameter, in seat 21.

A pivot 32 is rotatably secured to wok 10 opposite from handle 11, at a point slightly below the rim. A stand 31 is secured to base 40 on its lower end and secured to pivot 32 on its upper end.

When wok pan 10 is used for cooking foodstuff or otherwise not in a tilted position, plunger 111 of handle 11 rests against stopper 23 which is at the bottom of the upper cavity of seat 21. Spring 22 acts to cushion handle 11 when wok pan 10 is lowered and aids the operator in raising wok pan 10 when it is to be tilted.

The induction heating unit in depression 41 consists of a copper bowl shaped yoke 70, a magnetically permeable core 50, enclosed within yoke 70, wound with copper coil 60, and an external A.C. power supply (not shown).

Figure 2B:
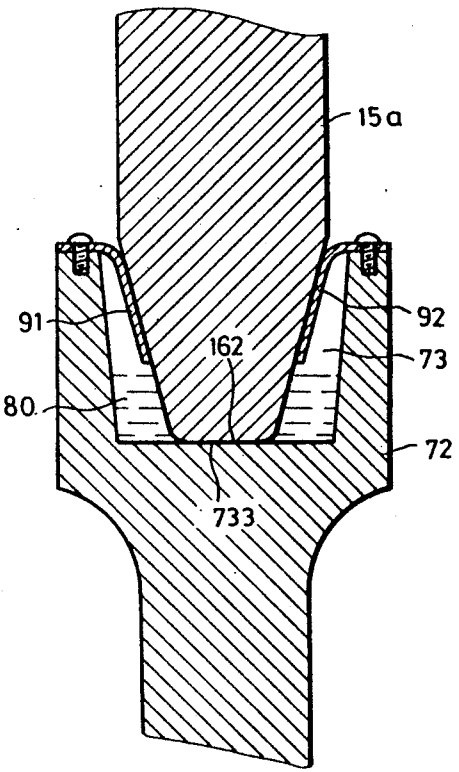
FIG. 2B is a sectional view of the conducting end of a contact rod inserted into the interior cavity of the contact well, of the bowl of the yoke of the induction heating unit of the improved structure induction heating wok of the present invention.
Figure 2A:
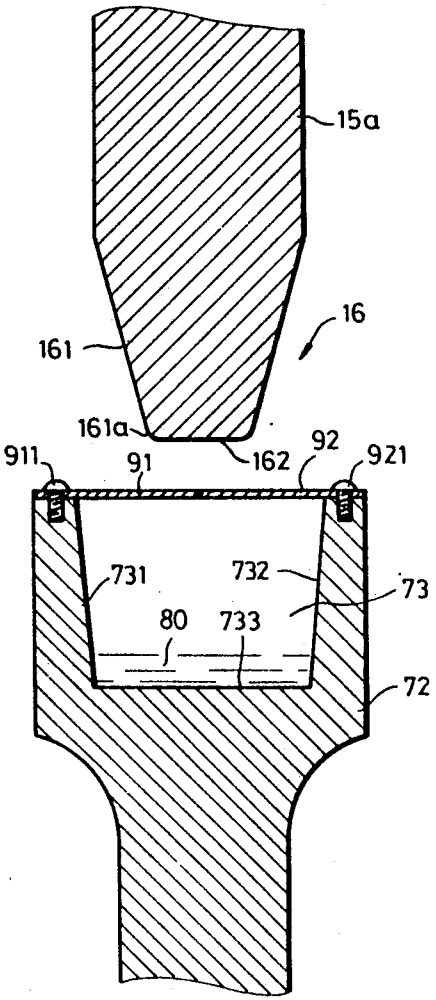
FIG. 2A is a sectional view of the conducting end of a contact rod and the interior cavity of the contact well, of the bowl of the yoke of the induction heating unit of the improved structure induction heating wok of the present invention.

An annular contact well 72 is formed on the upper rim of the bowl of yoke 70, as shown in cross-section in FIG. 2*a*. An annular, internal cavity 73 is formed within contact well 72, with an annular, entrance opening on the top thereof.

Internal cavity 73 is defined by an outer wall 731 on the left, an inner wall 732 on the right, and a flat contact face 732 on the bottom. Walls 731 and 732 slope inwards towards each other to join with flat contact face 733 at their lower edges. A pre-determined amount of liquid mercury 80 is deposited within internal cavity 73.

The entrance opeining to internal cavity 73 is covered by annular outer lip 91 and annular inner lip 92 which are made of polytetraflouroethylene. Outer lip 91 is secured to the upper rim of outer wall 731 by a plurality of threaded fasteners 911 disposed around the circumference of the upper rim. Likewise, inner lip 92 is secured to the upper rim of inner wall 732 by a plurality of threaded fasteners 921 disposed around the circumference of the upper rim of inner wall 732.

The inner rim of outer lip 91 and the outer rim of inner lip 92 just meet to seal off the entrance opening of internal cavity 73, to prevent foreign substances from entering internal cavity 73 and contaminating liquid mercury 80. They are, however, sufficiently thin and flexible to permit conducting ends 16 to enter, which will be discussed further below.

Again referring to FIG. 1, two cylindrical contact rods 15*a* and 15*b*, on the left and right, respectively, extend downwards from the bottom of wok pan 10. The lower ends of both contact rods 15*a* and 15*b* terminate in a conducting end 16, as shown in FIG. 2*a* for contact rod 15*a*.

Conducting end 16, with the shape of a truncated cone, is defined by a side wall 161, which tapers downwards to join with flat, circular contact face 162 through a rounded bevel 161*a*.

When wok pan 10 is in a lowered position, as when cooking foodstuff, the conducting ends 16 of both contact rods 15*a* and 15*b* are inserted into contact well 72 of yoke 70, to the left and the right, respectively, as shown in cross-section in FIG. 2*b* for contact rod 15*a*.

Conducting end 16 pushes outer lip 91 and inner lip 92 downwards and aside, and partly immersed into liquid mercury 80. Contact face 162 of conducting end 16 meets flushly with contact face 732 of internal cavity 73, separated only by a thin film of mercury 80.

Liquid mercury 80 offers a uniform and low resistance electrical conduction between contact faces 162 and 733, and protects them from damage due to arcing.

In operation, A.C. current supplied to coil 50, wound around core 60, from the external power supply, generates an alternating magnetic field which induces a current in yoke 70. The current passes through liquid mercury 80 in internal cavity 73 of yoke 70, to flow into wok pan 10 via contact rods 15*a* and 15*b*. Ohmic heating in wok pan 10 then heats any foodstuff contained therein.

Figure 3:
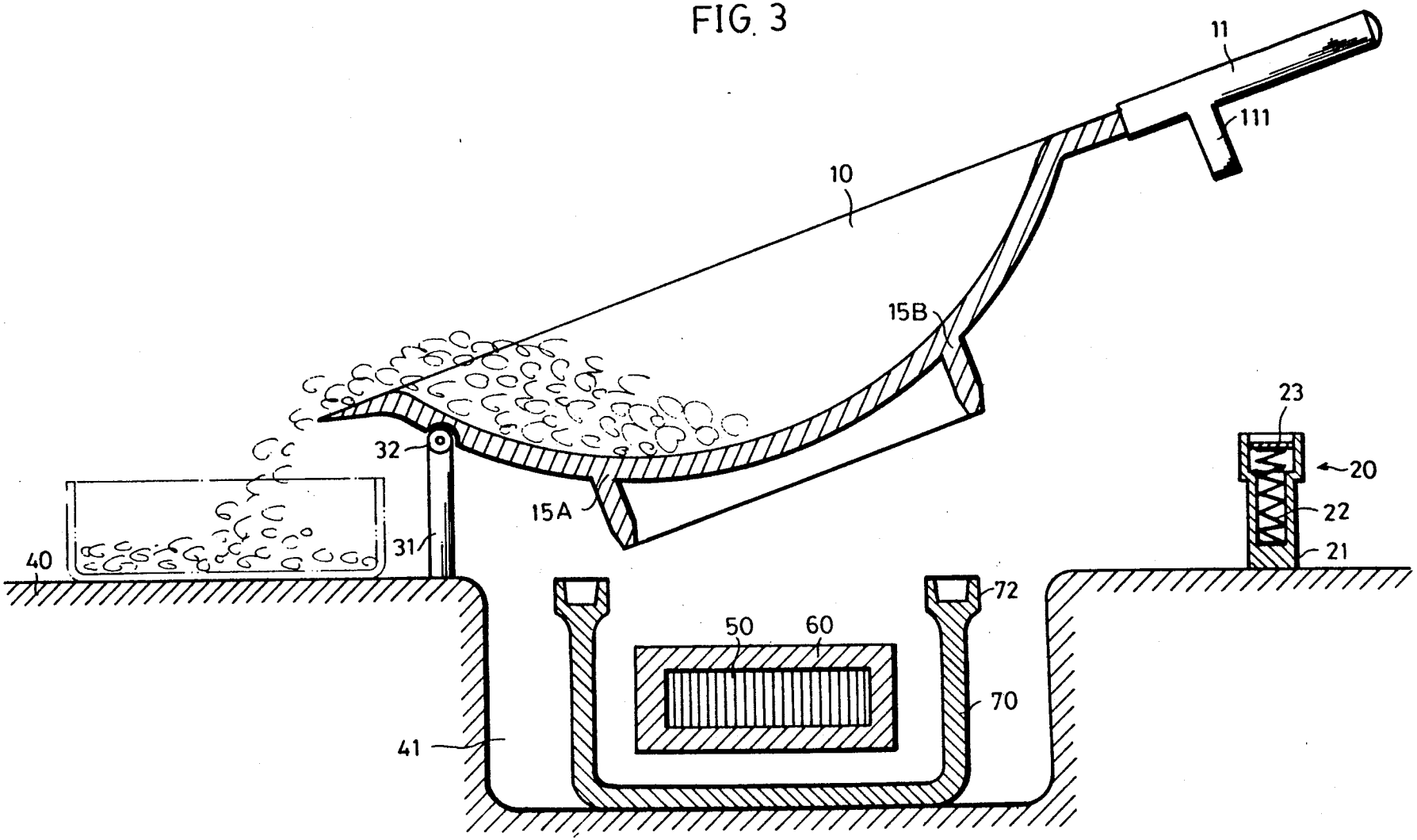
FIG. 3 is a schematic sectional view of the improved structure induction heating wok of the present invention, with the wok tilted and the foodstuff within being removed.

With the foodstuff sufficiently cooked and the power turned off, wok pan 10 can be tilted by lifting up handle 11 which causes wok pan 10 to rotate about pivot 32. the foodstuff within wok pan 10 can then be rapidly removed to another container as shown in FIG. 3.

Figure 4:
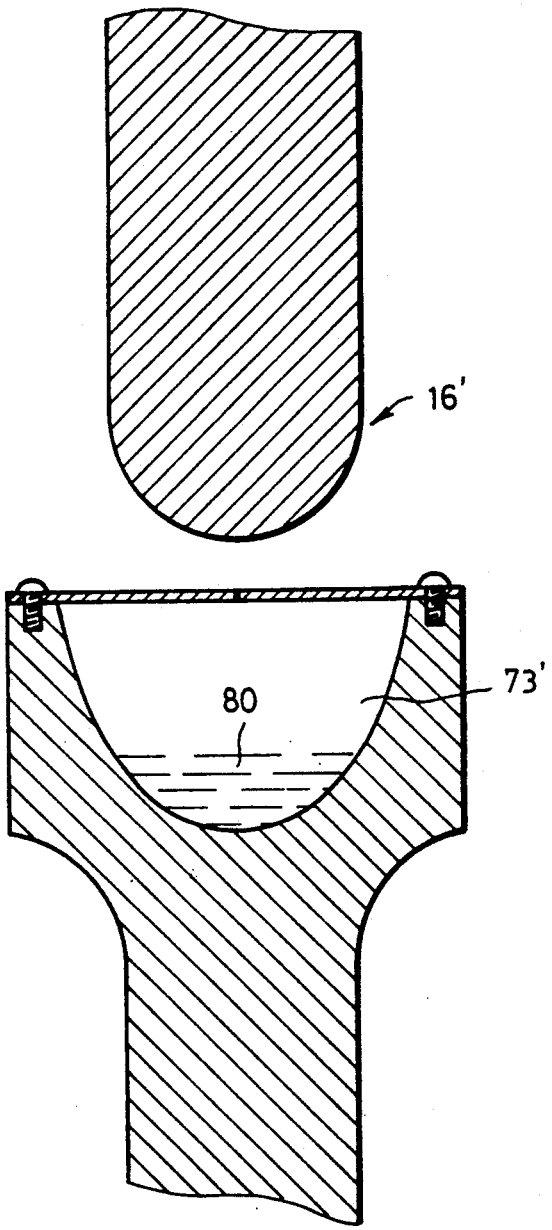
FIG. 4 is a sectional view of another embodiment of the conducting end of a contact rod and the interior cavity of the contact well, of the bowl of the yoke of the induction heating unit of the improved structure induction heating wok of the present invention.

In another embodiment, a conducting end 16' has a rounded hemispherical shape and an internal cavity 73' is formed with a semi-oval cross-section, as shown in FIG. 4. The shape of the respective components aids in preventing splashing of liquid mercury 80 upon insertion or removal of contact rods 15*a* and 15*b*, which may result in out splattering of mercury droplets from contact well 72.

I claim:

1. An improved structure induction heating wok comprising: a circular, concave metallic wok pan, with two electrically conducting, cylindrical contact rods projecting downwards from the lower surface of said wok pan, a handle extending laterally from the rim of said wok pan, a pivot, with one end thereon secured to said wok pan opposite said handle, the other end being secured to a base, a support, with one end secured to said base and the other end free, to support said handle, a bowl shaped electrically conducting yoke disposed under said wok pan and secured to said base, a magnetically permeable core wound with a copper coil and disposed within said yoke, and an external alternating current power supply supplying current to said copper coil wound over said core, wherein;

an annular contact well with an annular internal cavity is formed on the rim of said bowl shaped yoke, the outer side and inner side of said annular internal cavity slope inwards to join with the annular flat contact face of said internal cavity, a pre-determined amount of liquid mercury being disposed within said internal cavity;

the entrance opening to said internal cavity is covered by a thin annular outer lip and inner lip, made of flexible, high temperature resistant plastic, secured to the rim of said outer side and the rim of said inner side, respectively, by means of threaded fasteners, the inner rim of said outer lip touching the outer rim of said inner lip;

the lower end of each said contact rod terminates in a conducting end, formed in the shape of a truncated cone, which tapers downwards to join with a flat circular surface through a rounded bevel, said flat circular surface defining the contact face of said conducting end;

whereby, when said wok pan is in a lowered position with said handle resting against said support, as when cooking foodstuff in said wok pan, said conducting ends of said contact rods are inserted within said internal cavity of said contact well, said outer lip and inner lip are pushed downwards and aside, said conducting ends are partly immersed in said liquid mercury, and said contact face of said conducting end of each said contact rod meets flushly with said contact face of said internal cavity, separated by a thin film of said liquid mercury;

in operation, current in said yoke, induced by the varying magnetic field generated by said core, powered by current from said power supply in said coil, passes through said thin film of liquid mercury and said contact rods, and through said wok pan, causing ohmic heating therein, to cook said food stuff within said wok pan;

by manually lifting up said handle on said wok pan, said conducting ends of said contact rods retract from said internal cavity of respective said contact wells, said wok pan tilts about said pivot, facilitating rapid removal of said foodstuff from within said wok pan.

2. In improved structure induction heating wok according to claim 1, wherein said conducting end of each said contact rod is hemi-spherical in shape and said internal cavity of said contact well has a semi-oval cross-sectional shape.

* * * * *